US006511352B2

(12) United States Patent
Suzuki

(10) Patent No.: US 6,511,352 B2
(45) Date of Patent: Jan. 28, 2003

(54) CONNECTOR CONNECTION STRUCTURE

(75) Inventor: Shogo Suzuki, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/846,457

(22) Filed: May 2, 2001

(65) Prior Publication Data

US 2001/0044230 A1 Nov. 22, 2001

(30) Foreign Application Priority Data

May 17, 2000 (JP) ..... 2000-145307

(51) Int. Cl.[7] ..... H01R 24/00
(52) U.S. Cl. ..... 439/732; 439/271; 439/278
(58) Field of Search ..... 439/732, 271–78, 439/181, 148

(56) References Cited

U.S. PATENT DOCUMENTS 3,917,371 A * 11/1975 Hirokawa et al. ..... 439/189
4,455,056 A * 6/1984 Herrmann, Jr. et al. ..... 439/284
4,851,725 A 7/1989 Keck ..... 310/71
5,342,221 A * 8/1994 Peterson ..... 439/677
5,769,648 A * 6/1998 Hayashi ..... 439/206
6,193,536 B1 * 2/2001 Sanuki ..... 439/271

FOREIGN PATENT DOCUMENTS

GB 2 100 404 A 12/1982

* cited by examiner

*Primary Examiner*—Tho D. Ta
*Assistant Examiner*—Larisa Tsukerman
(74) *Attorney, Agent, or Firm*—Finnegan, Henderson, Farabow, Garrett & Dunner, L.L.P.

(57) ABSTRACT

A first connector 4 has a plurality of first terminal accommodating portions 3 which are disposed at a predetermined distance from each other and which have terminal accommodating chambers 1 accommodating female terminals 2. A second connector 8 has a plurality of second terminal accommodating portions 7 having terminal accommodating chambers 6 accommodating male terminals 5. The male terminal 5 comes into contact with the female terminals 2. The second terminal accommodating portions 7 has a leak preventing piece 11 for preventing a leak between the adjacent terminals 2. The leak preventing piece 11 projects from a connecting side tip end surface 7*a* of each of the second terminal accommodating portion 7, and the leak preventing piece 11 is inserted into a space 12 between the adjacent first terminal accommodating portions 3.

3 Claims, 4 Drawing Sheets

CONNECTOR CONNECTION STRUCTURE

BACKGROUND OF THE INVENTION

1. Field of the Invention

The present invention relates to a connector connection structure for connecting a pair of male and female connectors, and more particularly, to a connection structure capable of preventing a leak between adjacent terminals.

2. Description of the Related Art

As shown in FIG. 1, there is proposed a connector connection structure (not prior art) for connecting a first connector 104 and a second connector 108. The first connector 104 comprises a plurality of terminal accommodating portions 103 each having a terminal accommodating chamber 101 in which a female terminal 102 is accommodated. The terminal accommodating portions 103 are disposed at a predetermined distance from each other. The second connector 108 having a plurality of terminal accommodating portions 107 each having a terminal accommodating chamber 106 in which a male terminal 105 is accommodated. The male terminal 105 is brought into contact with the female terminal 102.

According to the connecting structure having such a structure, if tabs 105*a* of the male terminals 105 come into contact with terminal contacts 102*a* of the female terminals 102, the male terminals 105 and the female terminals 102 are brought into electrical conduction.

According to this connecting structure of this structure, however, as shown in FIG. 2, if a drop of water or the like enters into the terminal accommodating chamber 101 from the connected side between the first connector 104 and the second connector 108, there is an adverse possibility that the drop of water flows as shown with a dotted line in FIG. 2, and a leak is generated between the adjacent female terminals 102 (male terminals 105).

For example, in the field of automobile, a leak is prone to be generated between adjacent terminals of a connector due to increasing tendencies of voltage of circuit.

SUMMARY OF THE INVENTION

The present invention has been accomplished to solve the above problem, and it is an object of the invention to provide a reliable connecting structure capable of preventing a leak between adjacent terminals.

A first aspect of the present invention provides a connector connecting structure, comprising:

a first connector having a plurality of first terminal accommodating portions which are disposed at a predetermined distance from each other and which have terminal accommodating chambers accommodating first terminals; and a second connector mated with the first connector, having a plurality of second terminal accommodating portions having terminal accommodating chambers accommodating second terminals which are inserted into the terminal accommodating chambers of the first terminal accommodating portions and come into contact with the first terminals, wherein the second terminal accommodating portion has a leak preventing piece for preventing a leak between the adjacent terminals, the leak preventing piece projecting from a connecting side tip end surface of each of the second terminal accommodating portion, and the leak preventing piece inserted into a space between the adjacent first terminal accommodating portions.

According to the first aspect, the leak preventing piece for preventing a leak between the adjacent terminals is formed such as to project from a connecting side tip end surface of each of the second terminal accommodating portion, and the leak preventing piece is inserted into a space between the adjacent first terminal accommodating portions. Therefore, a distance (vertical plane distance, hereinafter) through which a drop of water flows along inner and outer surfaces of the terminal accommodating portion and reaches the adjacent terminal contacts is sufficiently secured, and the leak is prevented from being generated between the first and second terminals.

A second aspect of the present invention provides a connector connecting structure according to claim 1, wherein a length of the leak preventing piece is longer than a length of a tab of the second terminal projecting from the connecting side tip end surface of the second terminal accommodating portion.

According to the second aspect, since the length of the leak preventing piece is longer than the length of a tab of the mating terminal, when the first and second connectors are connected to each other, the leak preventing piece is guided by the space before the tab is guided by the first terminal accommodating portion, the connectors are connected to each other easily.

DESCRIPTION OF THE PREFERRED EMBODIMENT

A concrete embodiment to which the present invention is applied will be explained in detail with reference to the drawings below.

<Connecting Structure of Connector>

Figure 3:
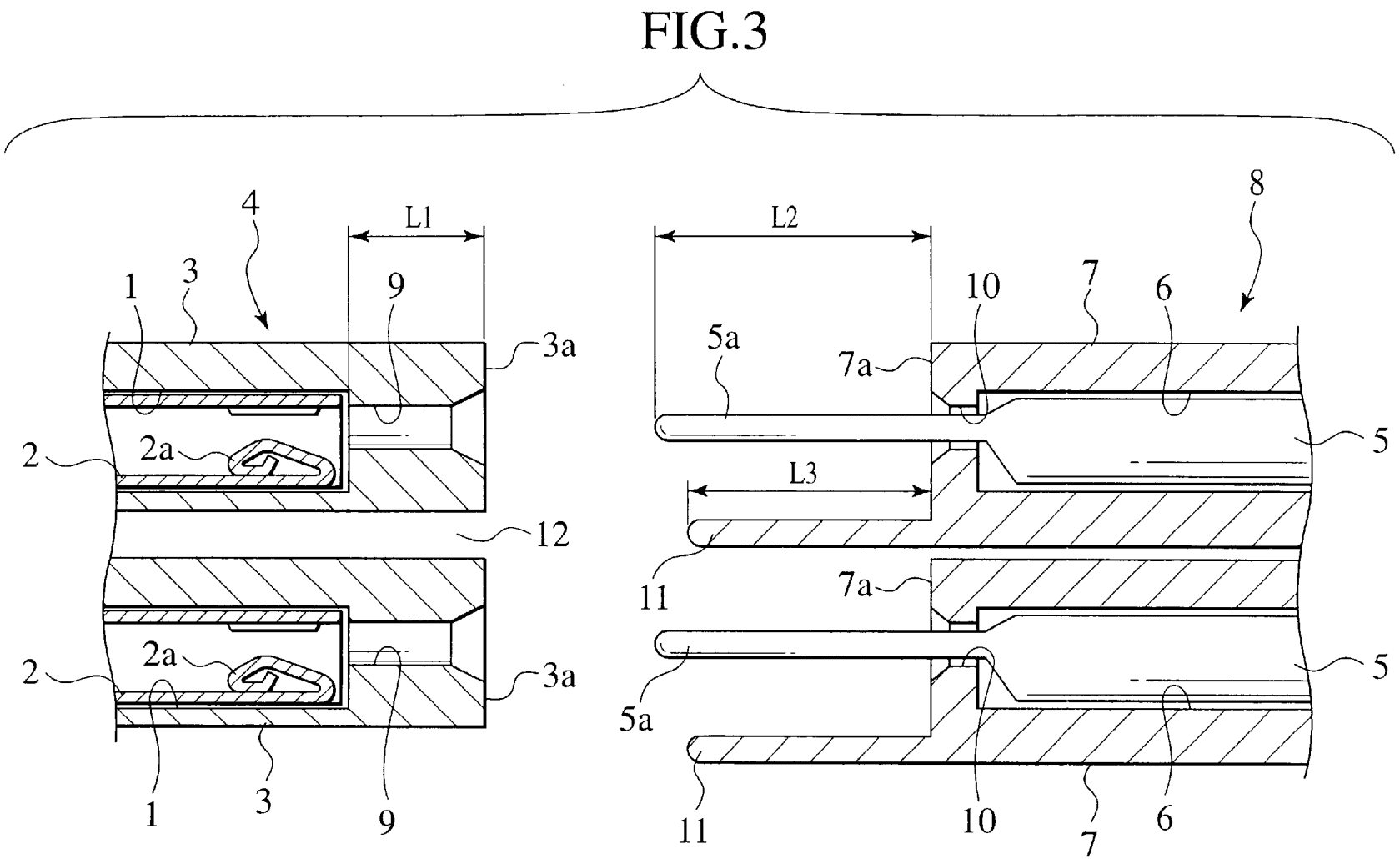
FIG. 3 is an enlarged sectional view of an essential portion of a connecting structure of an embodiment showing a state of first and second connectors before they are connected.
Figure 4:
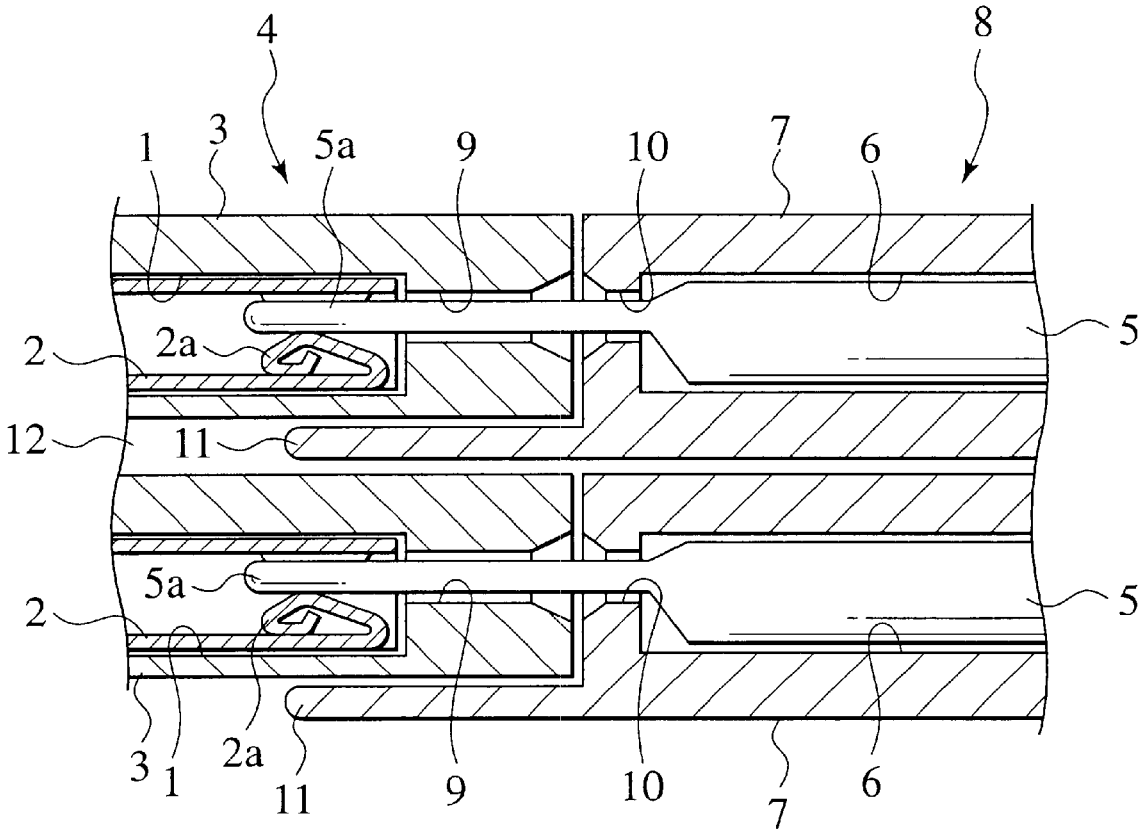
FIG. 4 is an enlarged sectional view of an essential portion of the connected first and second connectors.

As shown in FIGS. 3 and 4, a connector connecting structure of the present embodiment is for connecting a first connector 4 and second terminal accommodating portions 7, the first connector 4 having a plurality of first terminal accommodating portions 3 which are disposed at a predetermined distance from each other and which have terminal accommodating chambers 1 accommodating female terminals 2, and the second connector 8 having a plurality of second terminal accommodating portions 7 having terminal accommodating chambers 6 accommodating male terminals 5 which are mating terminals and respectively inserted into the terminal accommodating chambers 1 and which come into contact with the female terminals 2.

[First Connector]

As shown in FIGS. 3 and 4, the first connector 4 includes the plurality of first terminal accommodating portions 3. The first terminal accommodating portions 3 are disposed at a predetermined distance from each other on the connecting surface side with respect to the second connector 8. The first terminal accommodating portions 3 are integrally formed at their base ends. Each of the first terminal accommodating portions 3 is formed with the terminal accommodating chamber 1 for accommodating the female terminal 2. In each of the terminal accommodating chambers 1, the female terminal 2 having a terminal contact 2*a* which comes into contact with a tab 5*a* of the male terminal 5 (this will be described later).

Each of the first terminal accommodating portions 3 is formed with a terminal insertion hole 9 for allowing the tab 5*a* of the male terminal 5 to enter the terminal accommodating chamber 1. The terminal insertion hole 9 extends from a connecting side tip end surface 3*a* to the terminal accommodating chamber 1. A length L1 of the terminal insertion hole 9 is set slightly longer than a length employed in a normal connector so as to sufficiently secure a vertical plane distance between adjacent terminal contacts.

Figure 5:
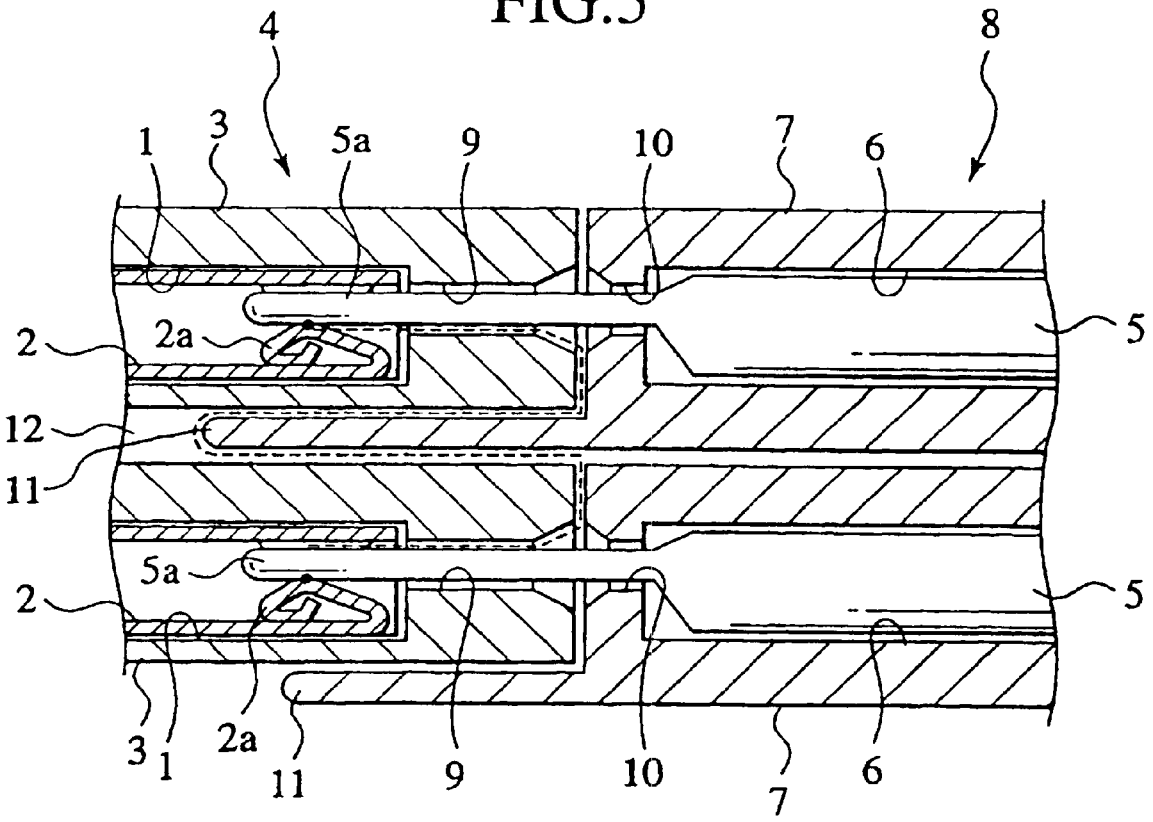
FIG. 5 is an enlarged sectional view of an essential portion of the connected state of the first and second connector, in which a vertical plane distance between adjacent terminal contacts is shown by a dotted line.

Although FIGS. 3 to 5 show only two first terminal accommodating portions 3 and two second terminal accommodating portions 7, but in an actual case, there exist three or more accommodating portions 3 and 7.

[Second Connector]

As shown in FIGS. 3 and 4, the second connector 8 includes the same number of second terminal accommodating portions 7 as that of the first terminal accommodating portions 3. The second terminal accommodating portions 7 are disposed at a predetermined distance on the connecting side with the first connector 4, and the second terminal accommodating portions 7 are integrally formed at their base ends. Each of the second terminal accommodating portions 7, the terminal accommodating chamber 6 for accommodating the male terminal 5 which comes into contact with the terminal contact 2*a* of the female terminal 2.

The second terminal accommodating portion 7 is formed with a tab insertion hole 10 for allowing the tab 5*a* of the male terminal 5 to project from a connection side tip end surface 7*a* toward outside of the terminal accommodating portion. The tab insertion hole 10 extends from the connecting side tip end surface 7*a* to the terminal accommodating chamber 6. A length L2 of the tab 5*a* projecting out from the terminal accommodating portion is set slightly longer than that of a normal connector so as to sufficiently secure a vertical plane distance between adjacent terminal contacts.

Further, a leak preventing piece 11 projects from the second terminal accommodating portion 7 for preventing a leak between adjacent terminals 2. The leak preventing piece 11 is formed into a tongue-like shape projecting outward from the connecting side tip end surface 7*a* of the second terminal accommodating portion 7. When the first connector 4 and the second connector 8 are connected to each other, the leak preventing piece 11 is inserted into a space 12 between the adjacent first terminal accommodating portions 3. A length L3 of the leak preventing piece 11 is set slightly longer than that of a normal connector so as to sufficiently secure a vertical plane distance between adjacent terminal contacts.

<Connecting Operation of Connectors>

The connecting operation between the first connector 4 and the second connector 8 having the above structure will be explained next.

First, as shown in FIG. 3, the first connector 4 and the second connector 8 are connected to each other while aligning them. Then, the tab 5*a* of the male terminal 5 accommodated in the terminal accommodating chamber 6 of the second terminal accommodating portion 7 enters into the terminal insertion hole 9 formed in the first terminal accommodating portion 3 before the leak preventing piece 11 enters. The connecting operation is proceeded further, and the leak preventing piece 11 enters the space 12 between the adjacent first terminal accommodating portions 3.

Then, when the first connector 4 and the second connector 8 are finally connected to each other, as shown in FIG. 4, the tab 5*a* comes into contact with the terminal contact 2*a* disposed in the terminal accommodating chamber 1, and the first connector 4 and the second connector 8 are brought into conduction. On the other hand, the leak preventing piece 11 enters into the space 12 between the adjacent first terminal accommodating portions 3.

Figure 1:
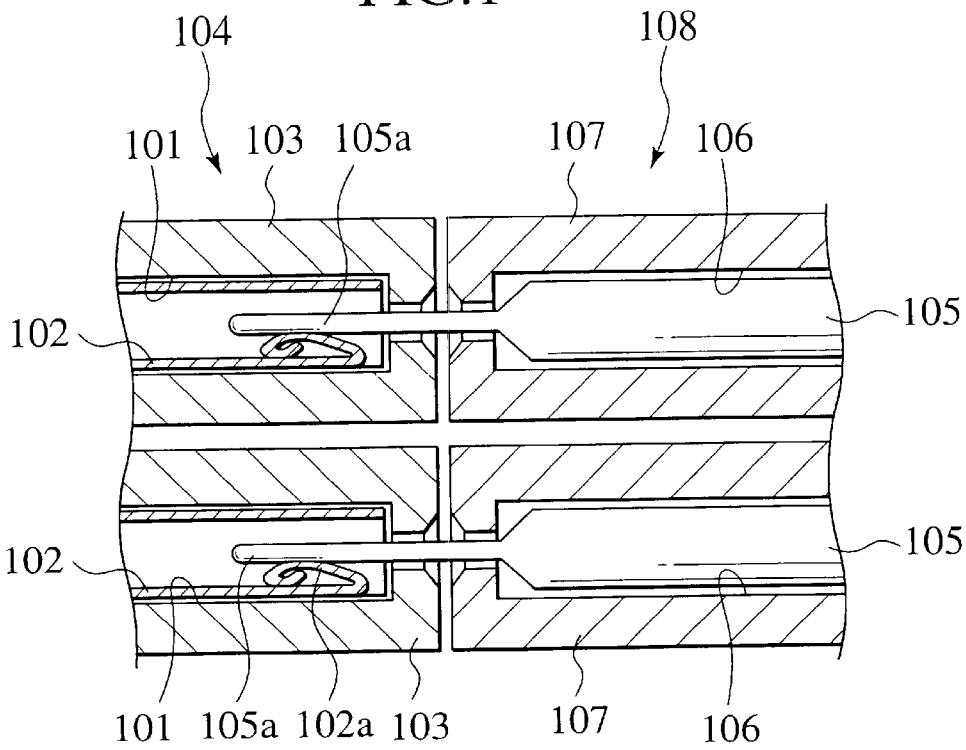
FIG. 1 is an enlarged sectional view of an essential portion of a connected state of a proposed connector.
Figure 2:
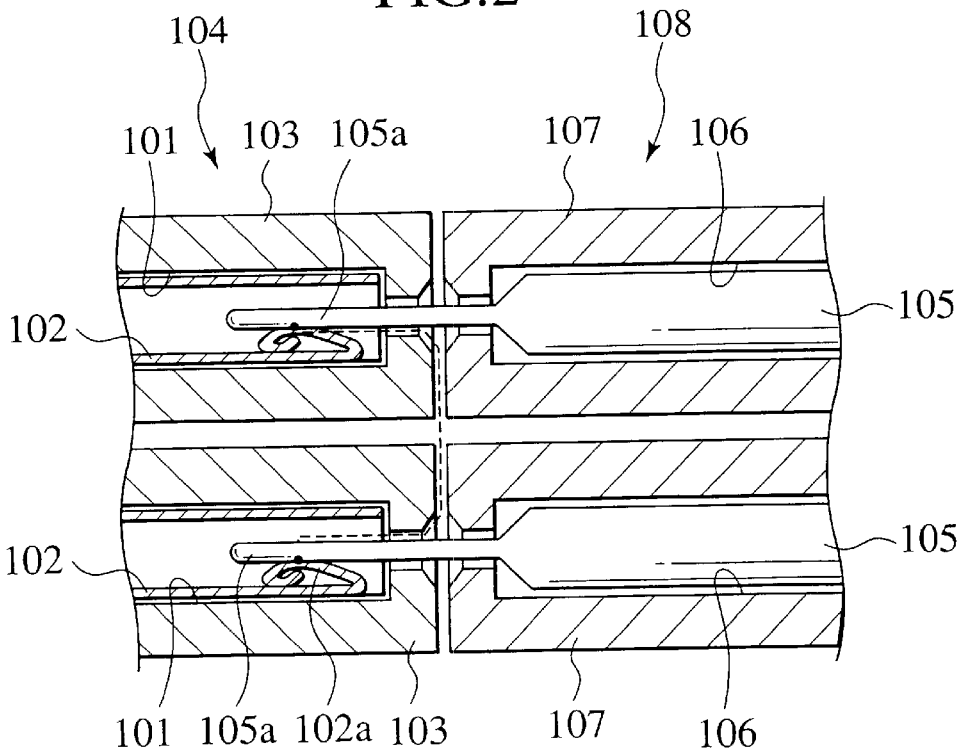
FIG. 2 is an enlarged sectional view of an essential portion of the connected state of the proposed connector, in which a vertical plane distance between adjacent terminal contacts is shown by a dotted line.

When the connecting operation between the first connector 4 and the second connector 8 is completed, as shown by a dotted line in FIG. 5, the vertical plane distance which is a way through which a drop of water passes along inner and outer surfaces of the terminal accommodating portion between the adjacent terminal contacts is sufficiently secured by the leak preventing piece 11 inserted into the space 12. The vertical plane distance is several times longer than a proposed connector (see FIG. 2), and it is difficult for the drop of water to reach one terminal contact from the other terminal contact.

In the present embodiment, all of the length L1 of the terminal insertion hole 9 of the first terminal accommodating portion 3, the length L2 of the tab 5*a* and the length L3 of the leak preventing piece 11 are longer than the conventional connector, it is possible to effectively prevent a leak from being generated between the adjacent terminals 2.

<Modification>

Although the length L3 of the leak preventing piece 11 is shorter than the length L2 of the tab 5*a* in the above embodiment, the length L3 of the leak preventing piece 11 may be longer than the length L2 of the tab 5*a*. With this arrangement, when the first connector 4 and the second connector 8 are connected to each other, the leak preventing piece 11 is inserted and guided in the space 12 before the tab 5*a* is inserted into the terminal insertion hole 9, the first and second connectors can be connected easily.

What is claimed is:

1. A connector connecting structure comprising:

a first connector comprising a plurality of first terminal accommodating portions disposed a predetermined distance from each other defining a space between adjacent first terminal accommodating portions, the first terminal accommodating portions each having a terminal accommodating chamber accommodating first terminals, and a terminal insertion hole having a length; and a second connector mated with the first connector, the second connector comprising a plurality of second terminal accommodating portions, the second terminal accommodating portions each comprising:

a second terminal accommodating chamber accommodating second terminals which are inserted into the terminal accommodating chambers of the first terminal accommodating portions and which come into contact with the first terminals;

a tab insertion hole having a length; and a leak preventing piece for preventing a leak between the adjacent first terminal accommodating portions, each leak preventing piece defining a length and projecting from each of the second terminal accommodating portions, and each leak preventing piece being inserted into the space between and defined by the adjacent first terminal accommodating portions, wherein the length of the terminal insertion hole of the first connector is longer than the length of the tab insertion hole of the second connector.

2. The connector connecting structure of claim 1, wherein a length of the leak preventing piece is longer than a length of a tab of a terminal projecting from a connecting side tip end surface of the second terminal accommodating portion.

3. The connector connecting structure of claim 1, wherein a length of the leak preventing piece is shorter than a length of a tab of a terminal projecting from a connecting side tip end surface of the second terminal accommodating portion.

* * * * *